US010355404B2

(12) United States Patent
Hirai et al.

(10) Patent No.: US 10,355,404 B2
(45) Date of Patent: Jul. 16, 2019

(54) HOUSING OF BOARD CONNECTOR, BOARD CONNECTOR AND BOARD CONNECTOR WITH CASE

(71) Applicant: Sumitomo Wiring Systems, Ltd., Yokkaichi, Mie (JP)

(72) Inventors: Kentaro Hirai, Mie (JP); Mitsunori Kitajima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/818,909

(22) Filed: Nov. 21, 2017

(65) Prior Publication Data

US 2018/0166824 A1 Jun. 14, 2018

(30) Foreign Application Priority Data

Dec. 9, 2016 (JP) ..... 2016-239156

(51) Int. Cl.

| | |
|---|---|
| ***H01R 13/627*** | (2006.01) |
| ***H01R 12/57*** | (2011.01) |
| ***H01R 12/71*** | (2011.01) |
| ***H01R 13/74*** | (2006.01) |
| *H01R 12/70* | (2011.01) |

(52) U.S. Cl.

CPC ..... *H01R 13/6272* (2013.01); *H01R 12/57* (2013.01); *H01R 12/716* (2013.01); *H01R 13/74* (2013.01); *H01R 12/7047* (2013.01); *H01R 12/7052* (2013.01); *H01R 13/6271* (2013.01)

(58) Field of Classification Search

CPC ..... H01R 13/6272; H01R 13/6271; H01R 13/6273

USPC ..... 439/78, 76.1

See application file for complete search history.

(56) References Cited

U.S. PATENT DOCUMENTS 5,145,356 A * 9/1992 Minnis ..... B60R 21/01 439/188
5,389,006 A * 2/1995 Noschese ..... H01R 13/6275 439/354
5,775,936 A * 7/1998 Tsuji ..... H01R 13/641 439/489
5,915,987 A * 6/1999 Reed ..... H01R 13/6275 439/258
5,997,344 A * 12/1999 Shinozaki ..... H01R 13/5213 439/188
6,086,411 A * 7/2000 Shinozaki ..... H01R 13/5219 439/188

(Continued)

FOREIGN PATENT DOCUMENTS

JP 2005-317357 11/2005
JP 2005317357 A * 11/2005 ..... H01R 13/639

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A housing (12) of a board connector (10) to be connected to a circuit board (P) is disposed such that a connection surface to a mating connector (50) is exposed to outside through an opening (41) of a case (40) capable of accommodating the circuit board (P) inside. The housing (12) includes outer locking protrusions (31) for locking a peripheral edge part of the opening (41) of the case (40) from outside of the case (40) so that the board connector (10) will not displace into the case (40) due to forces exerted by a mating connector (50) during a connection operation.

8 Claims, 9 Drawing Sheets

(56) References Cited

U.S. PATENT DOCUMENTS

| | | | | |
|---|---|---|---|---|
| 6,132,250 | A * | 10/2000 | Shinozaki | H01R 13/5216 439/587 |
| 6,371,796 | B2 * | 4/2002 | Fukuda | H01R 13/641 439/188 |
| 6,471,546 | B1 * | 10/2002 | Zhu | H01R 12/707 439/607.4 |
| 6,572,412 | B2 * | 6/2003 | Beuther | H05K 5/0069 439/381 |
| 6,676,434 | B2 * | 1/2004 | Ushio | H01R 12/58 439/352 |
| 6,837,734 | B2 * | 1/2005 | Ushio | H01R 12/58 439/249 |
| 7,121,864 | B1 * | 10/2006 | Yang | H04N 5/2253 439/331 |
| 7,140,908 | B2 * | 11/2006 | Katsuma | H01R 13/4364 439/489 |
| 7,419,385 | B2 * | 9/2008 | Itou | H01R 12/724 439/76.1 |
| 8,545,238 | B2 * | 10/2013 | Takeda | H01R 12/724 439/377 |
| 2002/0009905 | A1 * | 1/2002 | Poplawski | C07D 491/22 439/76.1 |
| 2002/0061673 | A1 * | 5/2002 | Ushio | H01R 12/58 439/357 |
| 2004/0033715 | A1 * | 2/2004 | Ushio | H01R 12/58 439/357 |
| 2012/0295469 | A1 * | 11/2012 | Takeda | H01R 12/724 439/377 |

* cited by examiner

HOUSING OF BOARD CONNECTOR, BOARD CONNECTOR AND BOARD CONNECTOR WITH CASE

BACKGROUND

Field of the Invention

The invention relates to a housing of a board connector, a board connector and a board connector with a case.

Description of Related Art

Japanese Unexamined Patent Publication No. 2005-317357 discloses a board connector that is connected to a circuit board accommodated in a case. A connection surface of the board connector is exposed to the outside through an opening of the case and is configured for connection to a mating connector. The case has supporting means for supporting the circuit board, and this supporting means is intended to support the board connector. However, the board connector may be displaced into the case when pressed in a connecting direction as the mating connector is connected to the board connector. A countermeasure has been desired since the circuit board may be distorted if the board connector is displaced.

The invention was completed based on the above situation and aims to provide a housing of a board connector, a board connector and a board connector with case capable of preventing the board connector from being displaced into a case when a mating connector is connected.

SUMMARY

The invention relates to a board connector with a housing to be connected to a circuit board. The circuit board is accommodated in a case and a connection surface of the housing is exposed to the outside through an opening of the case so that a mating connector can be connected to the board connector. The housing includes an outer locking protrusion that locks to a peripheral edge of the opening of the case from outside the case. The engagement of the outer locking protrusion with the case prevents the housing of the board connector from being displaced into the case when the mating connector is connected.

A terminal fitting is held in the housing of the board connector and is connected to the circuit board.

The housing of the board connector may include a locking structure for locking the mating connector in a properly connected state. A wall may stand laterally to the locking structure and may be connected to the outer locking protrusion. According to this configuration, the wall is reinforced by the outer locking protrusion to increase the durability of the outer locking protrusion.

The housing of the board connector may include an inner locking protrusion for locking the peripheral edge of the opening of the case from inside the case. According to this configuration, the inner locking protrusion is locked to the case so that the housing of the board connector will not be displaced to the outside of the case when separating the mating connector.

The housing of the board connector may have a lightened part formed in surfaces of the outer locking protrusion except a surface on a side to be held in contact with the case. Thus, a load acting on the outer locking protrusion that has been locked to the case is distributed widely as compared to a design where the lightened part is formed in the surface on the side to be held in contact with the case. Therefore, the durability of the outer locking protrusion can be increased.

The housing of the board connector may have a lightened part formed in surfaces of the inner locking protrusion except a surface on a side to be held in contact with the case. Thus, a load acting on the inner locking protrusion that has been locked to the case is distributed widely as compared to a design where the lightened part is formed in the surface on the side to be held in contact with the case. Thus, the durability of the inner locking protrusion can be increased.

Tapered surfaces may be formed on front end parts of the outer and inner locking protrusions in a mounting direction on the case. The tapered surfaces guide the peripheral edge of the opening into a space between the outer and the inner locking protrusions when inserting the housing to the peripheral edge of the opening of the case. Thus, the housing of the board connector can be mounted smoothly on the case.

DETAILED DESCRIPTION

Figure 1:
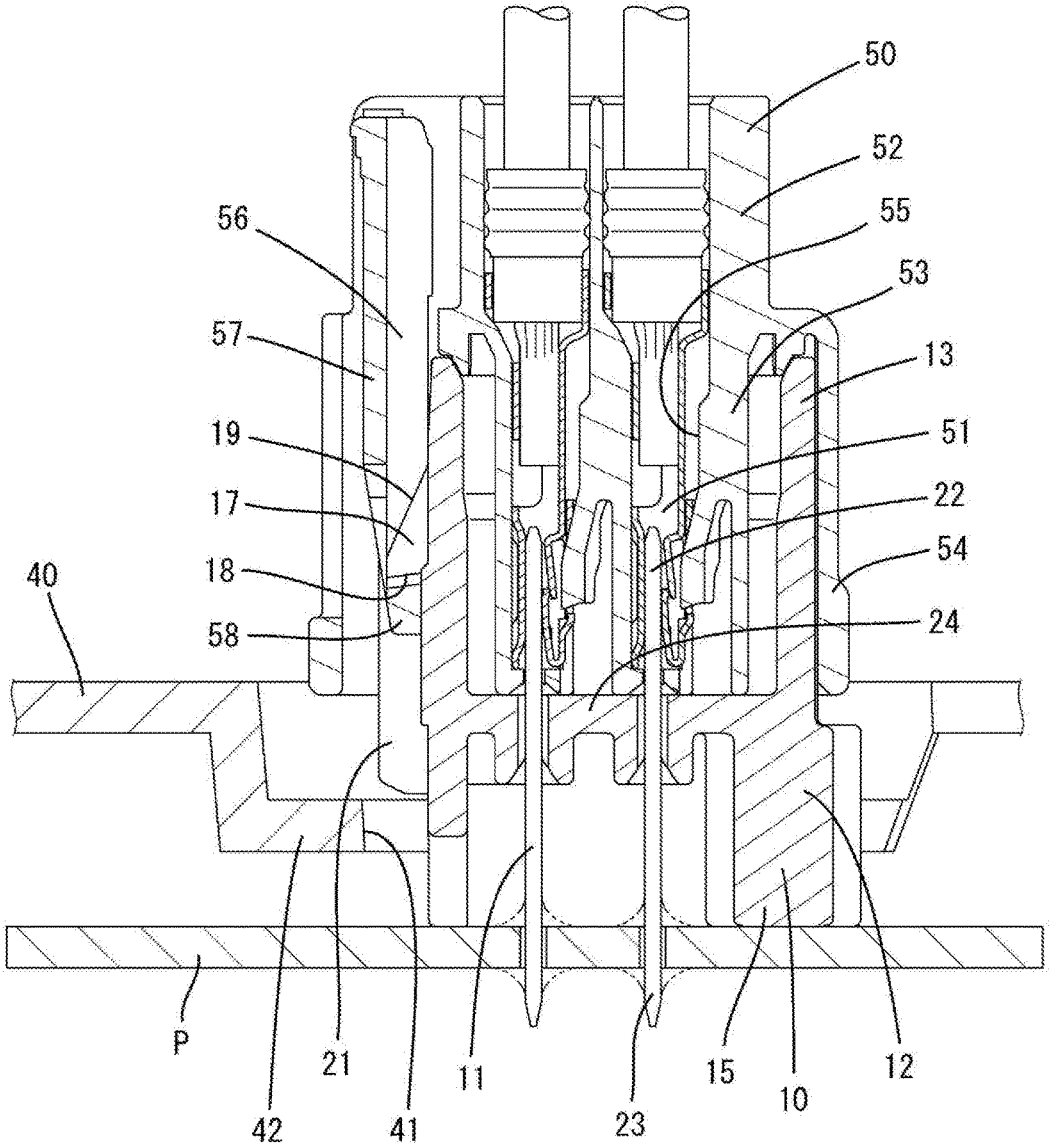
FIG. 1 is a section showing a state where a board connector and a mating connector are properly connected in an embodiment.

One specific embodiment of the invention is described with reference to FIGS. 1 to 9. This embodiment includes a board connector 10 connected to a circuit board P and a case 40 capable of accommodating the circuit board P inside. A connection surface of the board connector 10 to a mating connector 50 is exposed to the outside of the case 40 through an opening 41 of the case 40. The opening 41 of the case 40 communicates with the inside and outside of the case 40 and is open in a mounting direction of the board connector 10. Further, a peripheral edge 42 of the opening 41 is disposed at a position slightly retracted inwardly of the case 40 by a step provided on an outer peripheral edge thereof.

In the following description, in each constituent member, each of connection surfaces of the respective connectors 10, 50 (upper side of FIG. 1 for the board connector 10, lower side of FIG. 1 for the mating connector 50) is referred to as a front, and a left side (side where a locking structure is provided) and a right side of FIG. 1 are referred to as an upper side and a lower side.

The board connector 10 includes terminal fittings 11 (four in this embodiment) connected to the circuit board P and a housing 12 for holding the terminal fittings 11.

The housing 12 is made of synthetic resin and includes a receptacle 13 fittable to the mating connector 50. The receptacle 13 is a rectangular tube having with a nearly square cross sectional shape and is open forward.

Figure 2:
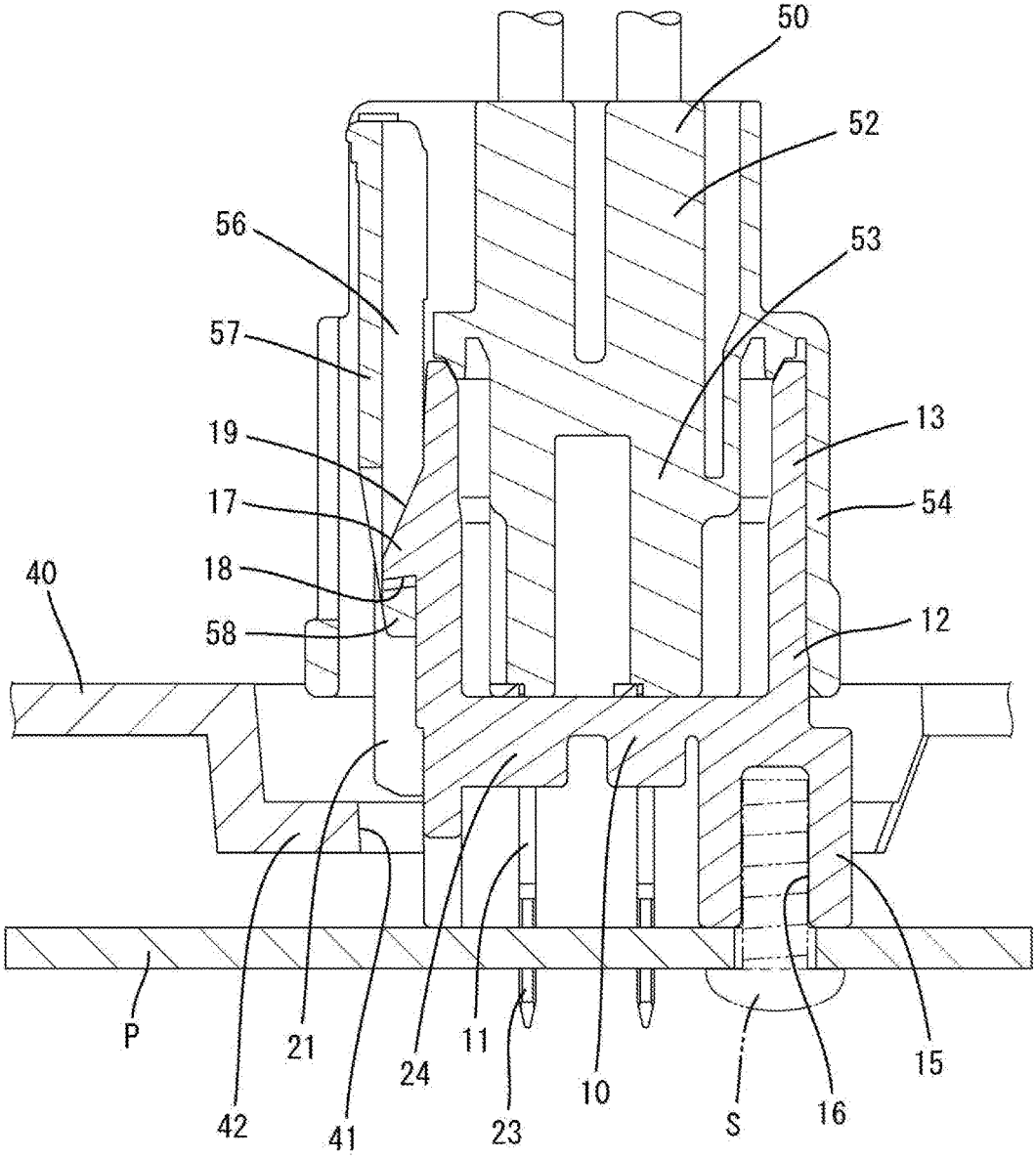
FIG. 2 is a section showing a state where the board connector and the mating connector are locked in a properly connected state.

As shown in FIG. 2, the housing 12 has a fixing portion 15 for fixing the circuit board P. The fixing portion 15 fixes the circuit board P using a screw S and has a hollow cylindrical shape with a screw hole 16 in a central part (see FIG. 4). The fixing portion 15 is provided on a rear part of the housing 12 and in a widthwise central part of the housing 12. The fixing portion 15 is at a position near a lower surface of the housing 12, and a part of the fixing portion 15 is exposed down from the lower surface of the housing 12. The circuit board P is fixed to the board connector 10 in an orientation so that plate surfaces thereof are substantially perpendicular to a front-rear direction.

The housing 12 has rotation stops 14 for stopping the rotation of the circuit board P. The rotation stops 14 project rearward from the rear surface of the housing 12 and penetrate through the circuit board P in a plate thickness direction. Two of the rotation stops 14 are provided on diagonal corners on the rear surface of the housing 12 (see FIG. 4).

Figure 3:
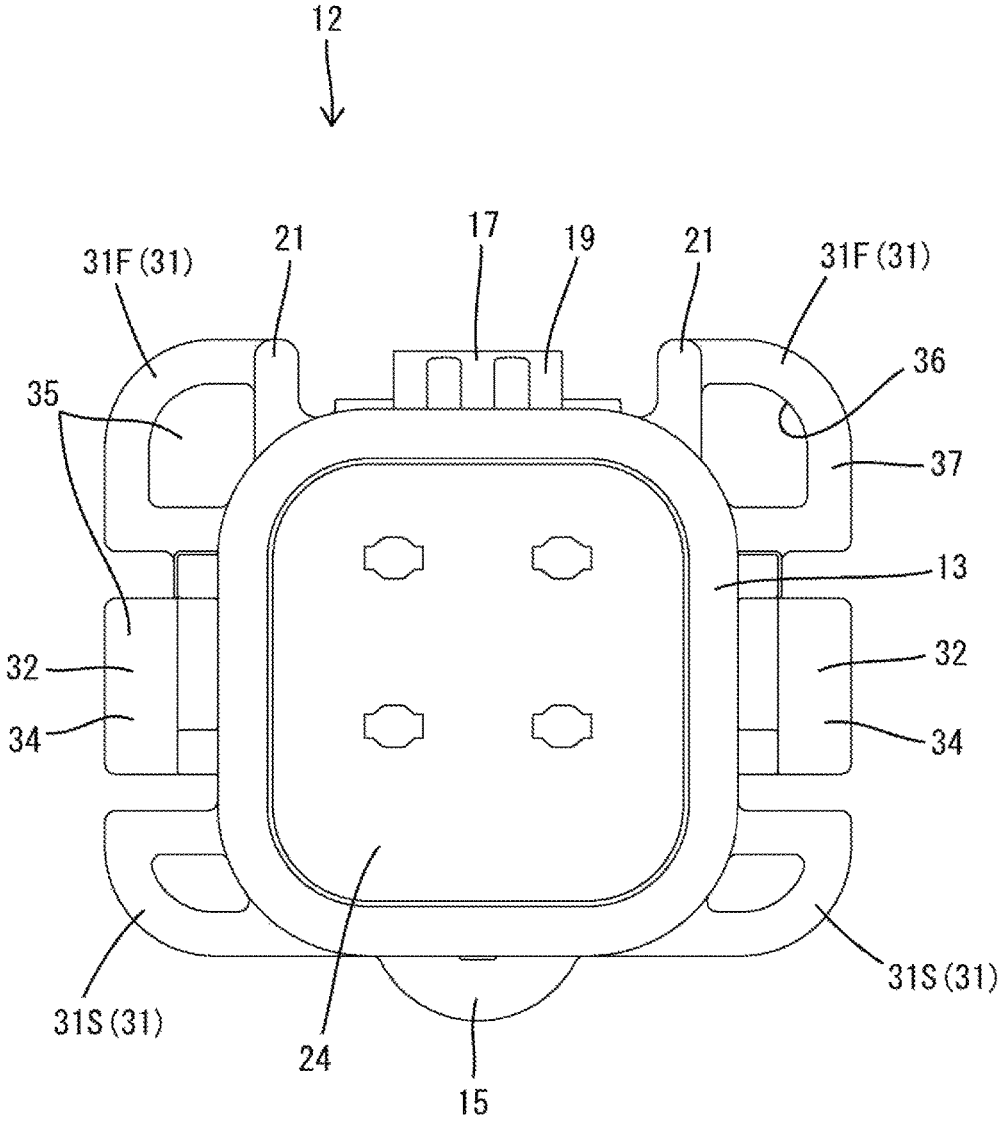
FIG. 3 is a front view of a housing.

The housing 12 has a lock projection 17 for locking the mating connector 50 in a properly connected state. As shown in FIG. 3, the lock projection 17 projects in a widthwise central part of the upper surface of the housing 12 and is near the front end of the housing 12, as shown in FIG. 2. The rear surface of the lock projection 17 defines a lock receiving portion 18 that is substantially perpendicular to the upper surface of the housing 12, and the front surface of the lock projection 17 defines a lock guiding portion 19 inclined to guide a movement of a lock arm 56 provided in the mating connector 50 onto the lock projection 17.

Figure 5:
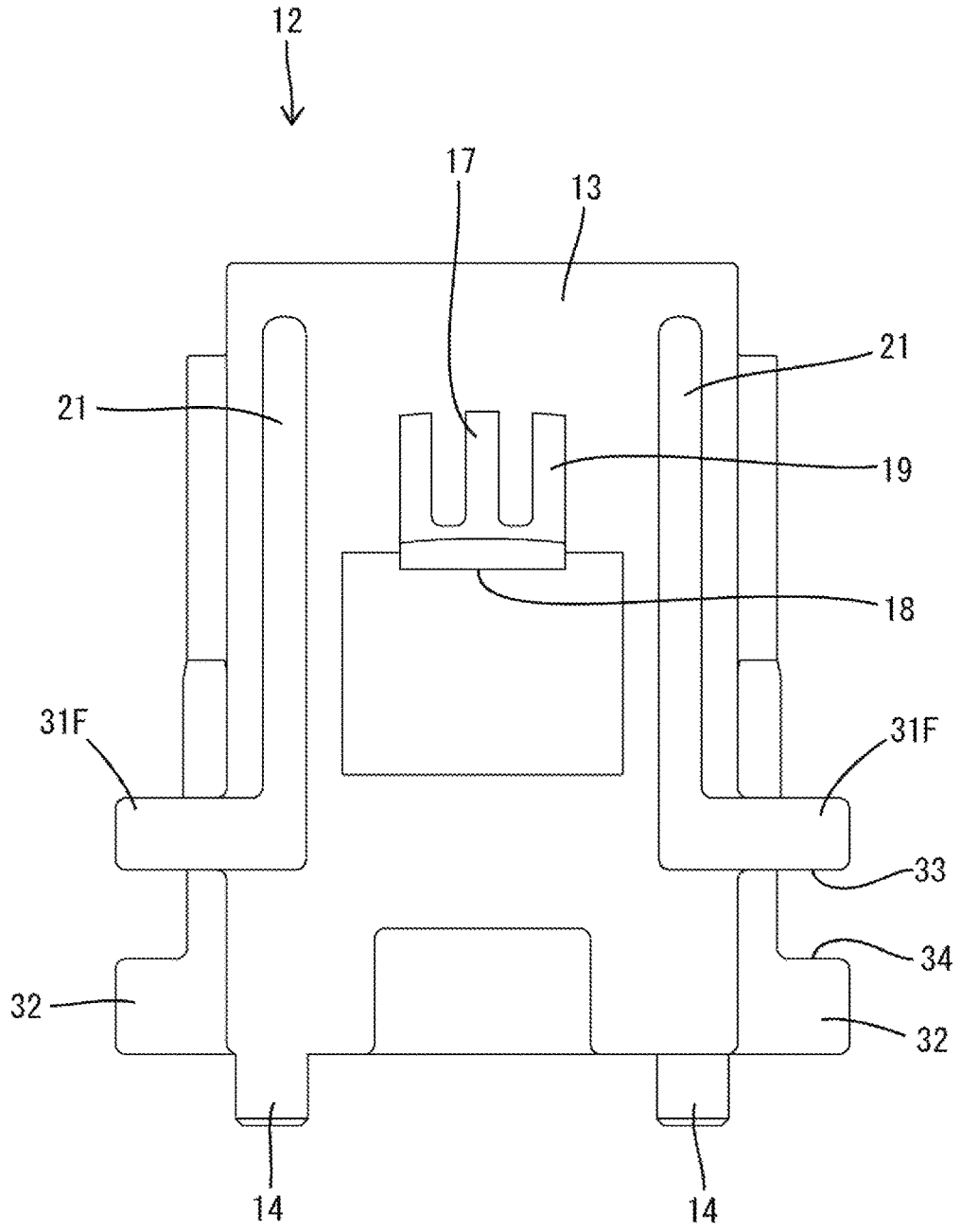
FIG. 5 is a plan view of the housing.
Figure 6:
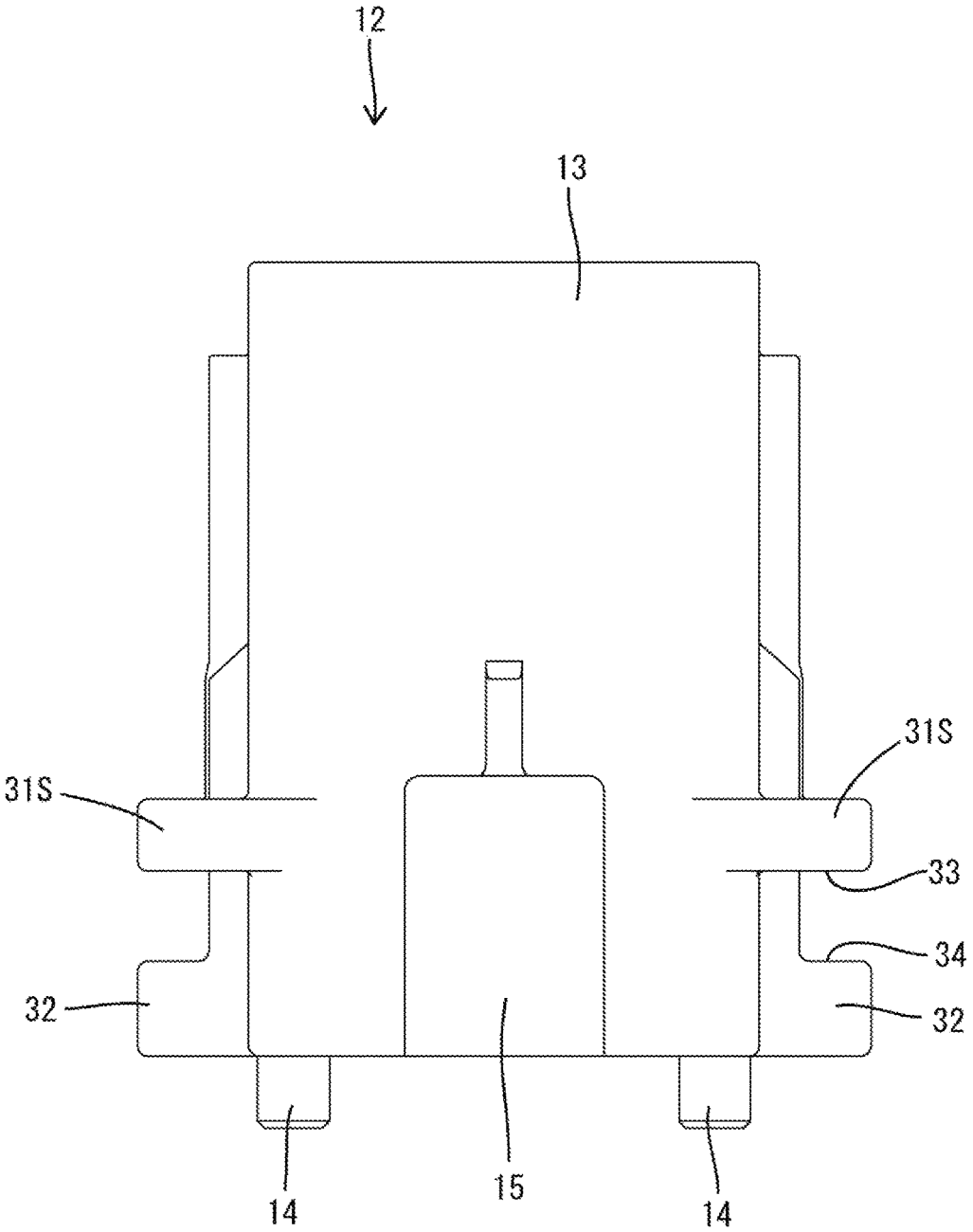
FIG. 6 is a bottom view of the housing.

As shown in FIG. 3, walls 21 are provided at both left and right sides of the lock projection 17 on the upper surface of the housing 12. Heights of the walls 21 are slightly larger than the height of the lock projection 17. As shown in FIG. 5, the walls 21 are long in the front-rear direction and extend straight from a position before the front end of the lock projection 17 to a position near the rear end of the housing 12.

The housing 12 includes outer locking protrusions 31 for locking the peripheral edge of the opening 41 of the case 40 from the outside and inner locking protrusions 31 for locking the peripheral edge from the inside. The outer and inner locking protrusions 31, 32 are described in detail later.

As shown in FIG. 1, the terminal fitting 11 is a long and narrow bar. One end of the terminal fitting 11 defines a connector-side connecting portion 22 to be connected electrically to the mating connector 50 and the other end defines a board-side connecting portion 23 to be connected electrically to the circuit board P. The terminal fitting 11 is straight and held in the housing 12 while penetrating through a terminal holding portion 24 on the rear end of the receptacle 13 in the front-rear direction. Terminal fittings 11 (four in this embodiment) are disposed side by side in vertical and lateral directions. The connector-side connecting portion 22 projects forward from the front connection surface of the terminal holding portion 24 and is connected conductively to the mating connector 50 fit to the receptacle 13. The board-side connecting portion 23 projects rearward from the housing 12 and is connected conductively to a conductive path of the circuit board P by soldering.

The mating connector 50 includes mating terminal fittings 51 connected to end parts of wires, and a mating housing 52 for holding the mating terminal fittings 51.

The mating housing 52 is made of synthetic resin and includes a terminal accommodating portion 53 for accommodating the mating terminal fittings 51 and an outer tube 54 that surrounds an outer periphery of the terminal accommodating portion 53. The terminal accommodating portion 53 is fit into the receptacle 13 and the outer tube 54 is fit externally on the receptacle 13. The terminal accommodating portion 53 has cavities 55 into which the mating terminal fittings 51 can be accommodated from behind.

Figure 9:
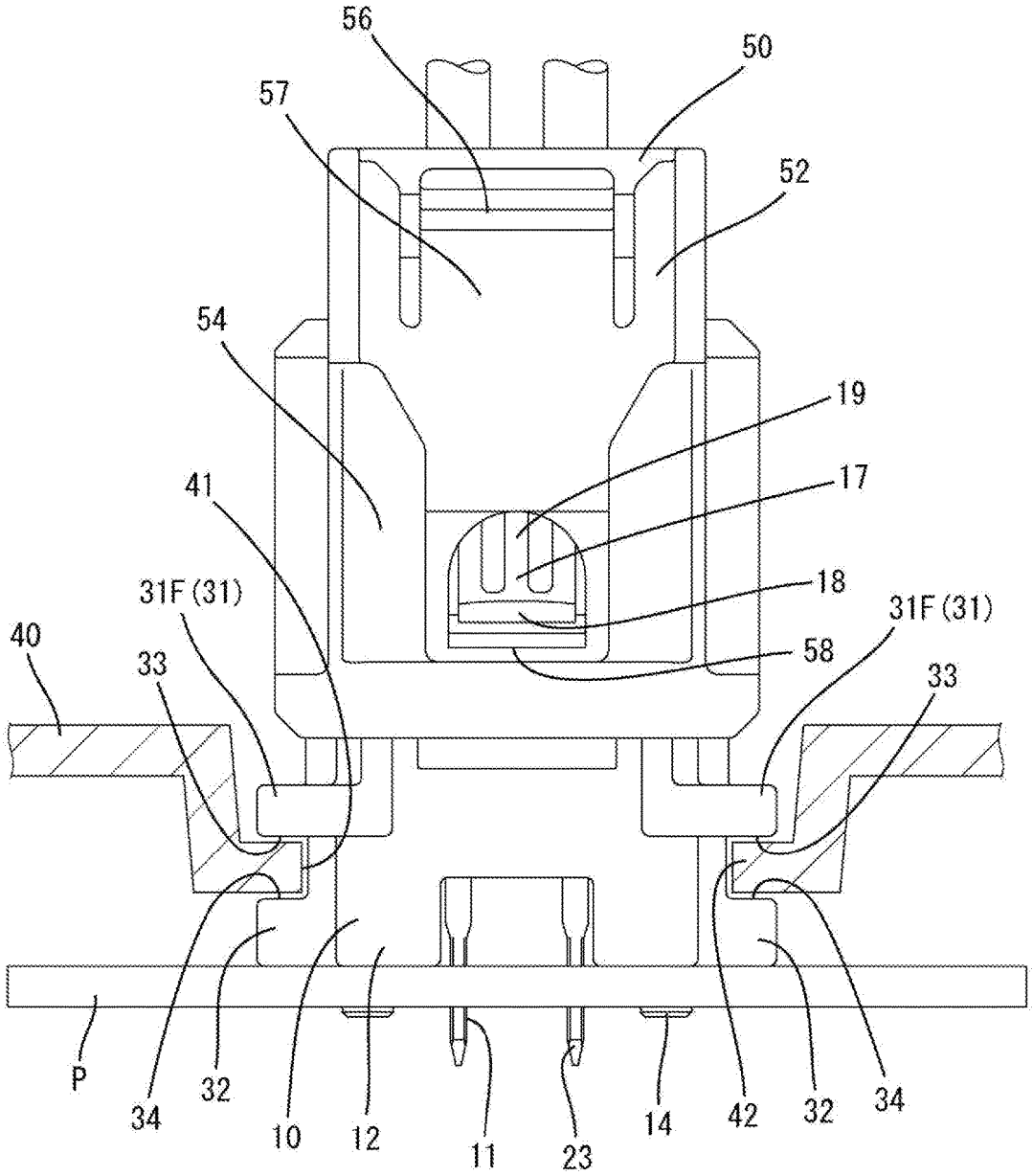
FIG. 9 is a section of the board connector with case showing a state where the outer locking protrusions and the inner locking protrusions are locking an opening peripheral edge part.

The mating housing 52 includes the lock arm 56 that is lockable to the lock projection 17 of the housing 12. As shown in FIG. 9, the lock arm 56 is in a widthwise central part of the mating housing 52. The lock arm 56 is supported on a central part of an arm 57 that is long in the front-rear direction, and is resiliently deflectable in a seesaw manner. A locking portion 58 is on a front part of the lock arm 56 and is locked to the lock receiving portion 18 of the lock projection 17.

As shown in FIG. 9, the housing 12 has the outer locking protrusions 31 for locking the opening peripheral edge part 42 of the case 40 from the outside of the case 40 and the inner locking protrusions 32 for locking the opening peripheral edge part 42 from the inside of the case 40.

The outer and inner locking protrusions 31, 32 are provided to project out (direction intersecting a connecting direction to the mating connector 50) from the outer peripheral surface of the housing 12. The outer and inner locking protrusions 31, 32 are substantially perpendicular to the outer peripheral surface of the housing 12. The inner locking protrusions 32 are provided on the rear end of the housing 12, and the outer locking protrusions 31 are provided at positions before the inner locking protrusions 32. An interval equivalent to a thickness of the opening peripheral edge 42 of the case 40 is defined between the outer and inner locking protrusions 31, 32. A thickness (dimension in the front-rear direction) of the outer locking protrusions 31 is smaller than that of the inner locking protrusions 32.

Figure 4:
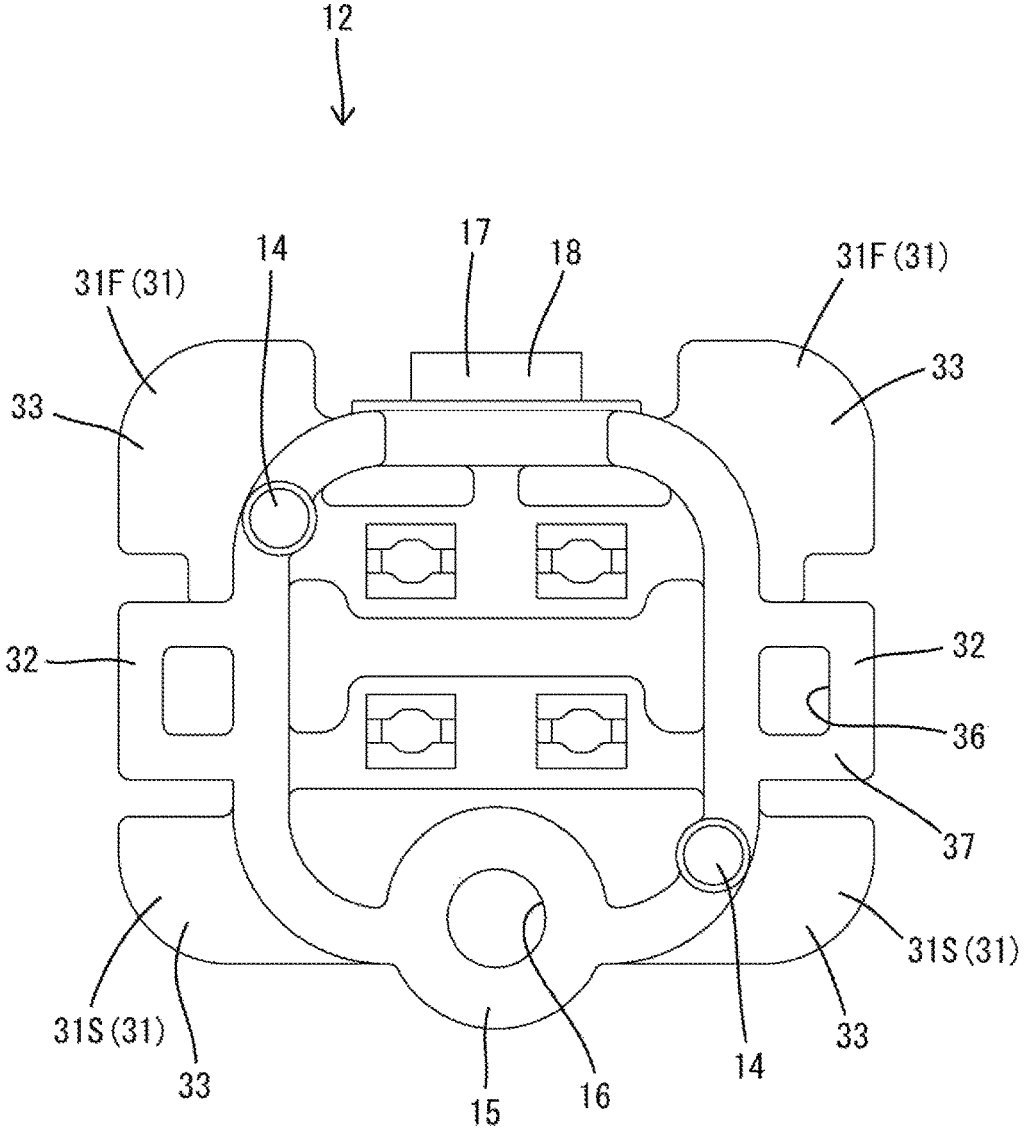
FIG. 4 is a back view of the housing.

The rear surfaces of the outer locking protrusions 31 define outer contact surfaces 33 capable of coming into surface contact with the outer surface of the case 40, and the front surfaces of the inner locking protrusions 32 define inner contact surfaces 34 capable of coming into surface contact with the inner surface of the case 40. As shown in FIGS. 3 and 4, the outer and inner contact surfaces 33, 34 are flat surfaces. Additionally, the rear surfaces of the inner locking protrusions 32 and the rear surface of the housing 12 are connected without any step.

As shown in FIG. 3, the outer locking protrusions 31 are provided intermittently in a circumferential direction of the housing 12. The outer locking protrusions 31 are at corners of the housing 12 and project in conformity with the roundness of the corners of the housing 12. Projecting end surfaces of the outer locking protrusions 31 are curved to be substantially parallel to the outer peripheral surface of the housing 12. In this way, such as when many housings 12 are managed collectively, the outer locking protrusions 31 will not contact and damage the other housings 12.

The outer locking protrusions 31 include two identically shaped first outer locking protrusions 31 provided on the upper corners of the housing 12 and two identically shaped second outer locking protrusions 31 provided on the lower corners of the housing 12. The outer locking protrusions 31 are symmetrical with respect to a widthwise center of the housing 12.

The first outer locking protrusions 31F project both left, right and up from the housing 12. Parts of the first outer locking protrusions 31F that project up from the housing 12 are linked to the walls 21. In other words, the first outer locking protrusions 31F project up from the housing 12 along wall surfaces of the walls 21. As shown in FIG. 5, the first outer locking protrusion 31F is connected at a right angle to the rear end of the wall 21 and the first outer locking protrusion 31F and the wall 21 form an L shape in a plan view.

As shown in FIG. 3, the second outer locking protrusions 31S project both left and right of the housing 12, but do not project down from the housing 12 and are with the lower surface of the housing 12 without any step. As shown in FIG. 4, the second outer locking protrusions 31S are adjacent to both left and right sides of the fixing portion 15. The outer contact surfaces 33 of the second outer locking protrusions 31S are smaller than the outer contact surfaces 33 of the first outer locking protrusions 31F.

The lower surfaces of the first outer locking protrusions 31F and the upper surfaces of the second outer locking protrusions 31S are substantially parallel to each other and substantially perpendicular to both left and right side surfaces of the housing 12.

As shown in FIG. 4, two of the inner locking protrusions 32 are provided on both left and right sides of the housing 12. The inner locking protrusions 32 are in a vertically central part of the housing 12 and are at positions vertically shifted from the outer locking protrusions 31.

When viewed from the front, the inner locking protrusions 32 have a square shape. Projecting end surfaces of the inner locking protrusions 32 are substantially parallel to both left and right side surfaces of the housing 12 and both upper and lower surfaces thereof are substantially perpendicular to the left and right side surfaces of the housing 12. The upper surfaces of the inner locking protrusions 32 are substantially parallel to the lower surfaces of the first outer locking protrusions 31F, and the lower surfaces of the inner locking protrusions 32 are substantially parallel to the upper surfaces of the second outer locking protrusions 31S.

Lateral projecting dimensions of the outer and inner locking protrusions 31 and 32 are equal. Thus, the projecting end surfaces of the outer and inner locking protrusions 31 and 32 are aligned in the lateral direction.

Lightened parts 36 are formed in the front surfaces (see FIG. 3) of the outer locking protrusions 31 and the rear surfaces (see FIG. 4) of the inner locking protrusions 32, i.e. surfaces except the surfaces on the sides to be held in contact with the case 40. The lightened parts 36 are formed by recessing central parts of the front surfaces of the outer locking protrusions 31 and the rear surfaces of the inner locking protrusions 32, while leaving outer edges 37. The outer edges 37 of the first outer locking protrusions 31F are connected to the walls 21. Note that the front surfaces of the outer locking protrusions 31 (back surfaces of the lightened parts 36) and the front surfaces of the inner locking protrusions 32 form pressing surfaces 35 to be pressed by unillustrated ejector pins for pressing and taking the housing 12 out from a mold.

Figure 7:
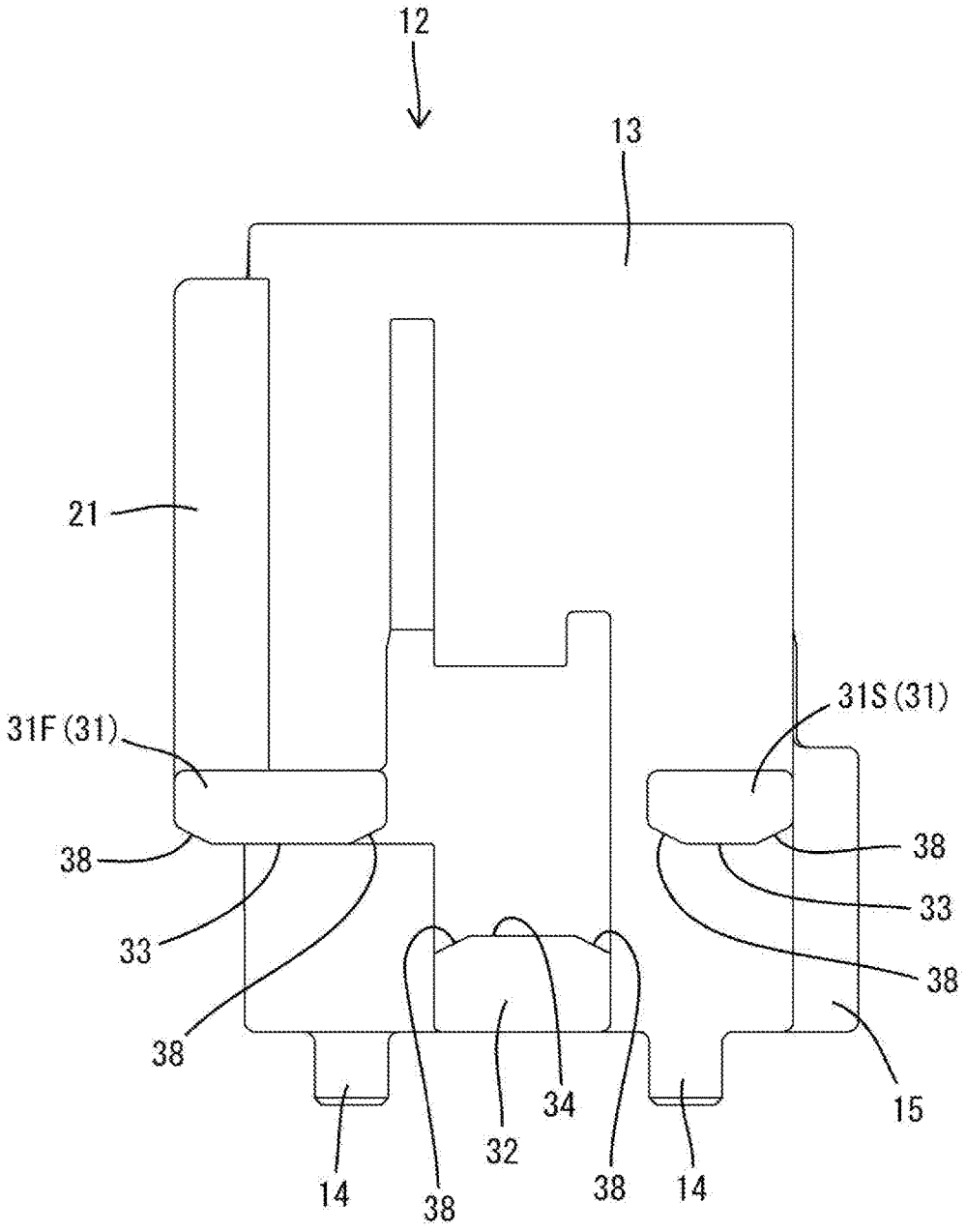
FIG. 7 is a side view of the housing.

Tapered surfaces 38 are formed on front end parts of the outer locking protrusions 31 and the inner locking protrusions 32 in a mounting direction on the case 40 (see FIG. 7). The tapered surfaces 38 are on all the outer and inner locking protrusions 31, 32. The tapered surfaces 38 are inclined on end parts of the outer contact surfaces 33 of the outer locking protrusions 31 and end parts of the inner contact surfaces 34 of the inner locking protrusions 32. The tapered surfaces 38 are on both upper and lower end parts of the outer contact surfaces 33 and both upper and lower end parts of the inner contact surfaces 34, i.e. on both front and rear end parts of the outer and inner contact surfaces 33, 34 in the mounting direction on the case 40, so as to deal with a case where the mounting direction of the housing 12 on the case 40 is reversed.

Next, an example of an operation of mounting the board connector 10 in this embodiment on the case 40 is described.

Figure 8:
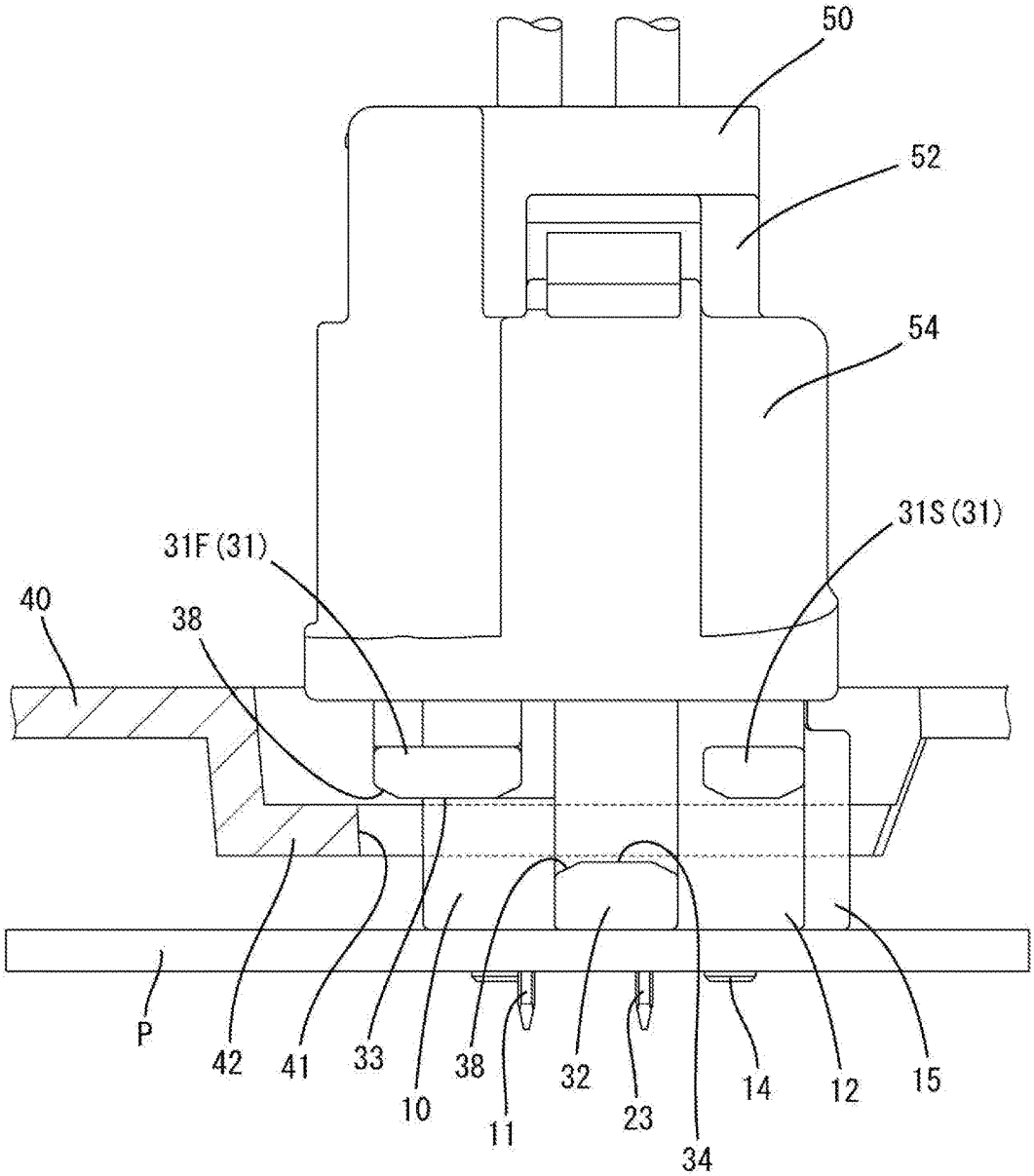
FIG. 8 is a section of a board connector with case showing tapered surfaces of outer locking protrusions and inner locking protrusions.

As shown in FIG. 8, the board connector 10 is slid into the opening 41 from an open side. The board connector 10 is slid so that the opening peripheral edge 42 is inserted between the outer and inner locking protrusions 31 and 32. At this time, when the tapered surfaces 38 of the outer locking protrusions 31 contact the opening peripheral edge 42, the board connector 10 is displaced forwardly by the inclination of the tapered surfaces 38 and the outer locking protrusions 31 are disposed outside the opening peripheral edge 42. Further, when the tapered surfaces 38 of the inner locking protrusions 32 contact the opening peripheral edge 42, the board connector 10 is displaced rearward by the inclination of the tapered surfaces 38, and the inner locking protrusions 32 are disposed inside the opening peripheral edge 42. In this way, the opening peripheral edge 42 is guided smoothly into a space between the outer locking protrusions 31 and the inner locking protrusions 32, and the board connector 10 is inserted toward a back side of the opening 41 from the open side and reaches a proper mounted position. The circuit board P of the board connector 10 is supported by an unillustrated supporting structure of the case 40 so that the board connector 10 is mounted on the case 40.

In the board connector 10 mounted on the case 40, the outer locking protrusions 31 also prevent external matter from entering into the case 40. Specifically, a clearance between the opening peripheral edge part 42 of the case 40 and the housing 12 of the board connector 10 is partly covered by the outer locking protrusions 31. Thus, external matter cannot enter into the case 40 through this clearance. External matter that might otherwise have entered the case 40 could cause a conduction failure at solder connection positions of the circuit board P and the terminal fittings 11 and could short-circuit a board circuit.

Next, examples of a connecting operation and a separating operation of the board connector 10 and the mating connector 50 in this embodiment are described.

First, the operation of connecting the board connector 10 and the mating connector 50 is described. The both connectors 10, 50 are fit to insert the terminal accommodating portion 53 of the mating connector 50 into the receptacle 13 of the board connector 10. At this time, the board connector 10 is pushed rearward and, in the prior art, could be displaced rearwardly into the case 40. However, the outer contact surfaces 33 of the outer locking protrusions 31 contact the outer surface of the opening peripheral edge 42 to stop a rearward displacement of the board connector 10 into the case 40. When the connectors 10, 50 reach a properly connected state, the lock arm 56 of the mating connector 50 moves over the lock projection 17 of the board connector 10 to resiliently return. Thus, the lock arm 56 and the lock projection 17 are locked and the mating terminal fittings 51 and the terminal fittings 11 are connected electrically.

Next, the operation of separating the board connector 10 and the mating connector 50 is described. The lock arm 56 of the mating connector 50 is displaced in an unlocking direction to be unlocked from the lock projection 17, and the mating connector 50 and the board connector 10 are pulled apart. At this time, the board connector 10 is pulled forward and, in the prior art, could be displaced the outside of the case 40. However, the inner contact surfaces 34 of the inner locking protrusions 32 contact the inner surface of the opening peripheral edge part 42 to stop a forward displacement of the board connector 10, and the connectors 10, 50 are separated from each other.

The housing 12 of the board connector 10 of this embodiment is disposed such that the connection surface to the mating connector 50 is exposed to outside through the opening 41 of the case 40 that is capable of accommodating the circuit board P inside, and includes the outer locking protrusions 31 for locking the opening peripheral edge part 42 of the case 40 from the outside of the case 40. According to this configuration, when connecting the mating connector 50, the outer locking protrusions 31 lock the opening peripheral edge part 42 from the outside of the case 40 to prevent a displacement of the housing 12 of the board connector 10 into the case 40.

The housing 12 includes the lock projection 17 for locking the mating connector 50 in the properly connected state and the walls 21 standing laterally to the lock projection 17. The walls 21 are connected to the outer locking protrusions 31. Accordingly, the outer locking protrusions 31 are reinforced by the walls 21, and the durability of the outer locking protrusions 31 is increased.

The housing 12 includes the inner locking protrusions 32 for locking the opening peripheral edge 42 of the case 40 from the inside of the case 40. The inner locking protrusions 32 prevent a displacement of the housing 12 of the board connector 10 to the outside of the case 40 when separating the mating connector 50.

The lightened parts 36 are formed in the surfaces of the outer and inner locking protrusions 31, 32 except the surfaces on the sides to be held in contact with the case 40. Thus, the areas of the outer contact surfaces 33 of the outer locking protrusions 31 and the inner contact surfaces 34 of the inner locking protrusions 32 are not reduced by the lightened parts 36. In this way, a load acting on the outer and inner locking protrusions 31 and 32 when the outer or inner locking protrusions 31 or 32 are locked to the case 40 is distributed widely as compared to the case where lightened parts are formed in the outer and inner contact surfaces 33, 34. Thus, the durability of the outer and inner locking protrusions 31, 32 can be increased. Further, when the opening peripheral edge 42 of the case 40 is inserted into the space between the outer locking protrusions 31 and the inner locking protrusions 32, the opening peripheral edge 42 is unlikely to be caught by the outer locking protrusions 31 or the inner locking protrusions 32 since no lightened part is formed in the outer and inner contact surfaces 33, 34. Therefore, the housing 12 of the board connector 10 can be mounted smoothly on the case 40.

The tapered surfaces 38 are formed on the front end parts of the outer and inner locking protrusions 31, 32 in the mounting direction on the case 40. According to this configuration, when the opening peripheral edge 42 of the case 40 is inserted into the space between the and inner locking protrusions 31 and 32, the opening peripheral edge 42 is guided into the space between the outer and inner locking protrusions 31, 32 by the inclination of the tapered surfaces 38. Therefore, the housing 12 of the board connector 10 can be mounted smoothly on the case 40.

The invention is not limited to the above described embodiment. For example, the following embodiments are also included in the scope of the invention.

Although examples of the locking structures are illustrated in the above embodiment, there is no limitation to this and the configurations of the locking structures can be arbitrarily changed. For example, the board connector may be provided with the lock arm and the mating connector may be provided with the lock projection.

Although the housing 12 includes the inner locking protrusions 32 in the above embodiment, there is no limitation to this and the inner locking protrusions may not be provided.

Although the numbers, shapes and sizes and the like of the outer and inner locking protrusions 31, 32 are illustrated in the above embodiment, there is no limitation to this and the numbers, shapes and sizes and the like of the outer and inner locking protrusions can be changed.

Although the lightened parts 36 are formed in the front surfaces of the outer locking protrusions 31 and the rear surfaces of the inner locking protrusions 32 in the above embodiment, there is no limitation to this and the surfaces provided with the lightened parts can be changed.

Although the tapered surfaces 38 are provided on both rear and front end parts of the outer and inner locking protrusions 31, 32 in the mounting direction on the case 40 in the above embodiment, there is no limitation to this and the tapered surfaces may be provided only on the front end parts in the mounting direction on the case.

LIST OF REFERENCE SIGNS

P . . . circuit board
10 . . . board connector
11 . . . terminal fitting
12 . . . housing
17 . . . lock projection
21 . . . wall
31 . . . outer locking protrusion
32 . . . inner locking protrusion
33 . . . outer contact surface
34 . . . inner contact surface
36 . . . lightened part
38 . . . tapered surface
40 . . . case
41 . . . opening
42 . . . opening peripheral edge
50 . . . mating connector
56 . . . lock arm

What is claimed is:

1. A housing of a board connector to be connected to a circuit board, the housing being disposed such that a connection surface to a mating connector is exposed to outside through an opening of a case capable of accommodating the circuit board inside, the housing comprising:

an outer locking protrusion for locking a peripheral edge of the opening of the case from outside of the case; and a lightened part formed in surfaces of the outer locking protrusion except a surface on a side to be held in contact with the case.

2. The housing of the board connector of claim 1, comprising:

a locking structure for locking the mating connector in a properly connected state; and a wall standing laterally to the locking structure, the wall being connected to the outer locking protrusion.

3. The housing of the board connector of claim 1, comprising an inner locking protrusion for locking the peripheral edge of the opening of the case from inside the case.

4. A board connector, comprising:

the housing of the board connector of claim 1; and a terminal fitting to be held in the housing and connected to a circuit board.

5. A board connector with case, comprising:

the board connector of claim 4; and a case capable of accommodating the circuit board inside.

6. A housing of a board connector to be connected to a circuit board, the housing being disposed such that a connection surface to a mating connector is exposed to outside through an opening of a case capable of accommodating the circuit board inside, the housing comprising:

an outer locking protrusion for locking a peripheral edge of the opening of the case from outside of the case;

an inner locking protrusion for locking the peripheral edge of the opening of the case from inside the case; and a lightened part formed in surfaces of the inner locking protrusion except a surface on a side to be held in contact with the case.

7. A housing of a board connector to be connected to a circuit board, the housing being disposed such that a connection surface to a mating connector is exposed to outside through an opening of a case capable of accommodating the circuit board inside, the housing comprising:

an outer locking protrusion for locking a peripheral edge of the opening of the case from outside of the case;

an inner locking protrusion for locking the peripheral edge of the opening of the case from inside the case; and tapered surfaces formed on front end parts of the outer and inner locking protrusions in a mounting direction on the case.

8. The housing of the board connector of claim 7, wherein a lightened part is formed in surfaces of the outer locking protrusion except a surface on a side to be held in contact with the case.

* * * * *